US005605238A

United States Patent [19]

Jacobs

[11] Patent Number: 5,605,238

[45] Date of Patent: Feb. 25, 1997

[54] SHELVING SYSTEM

[75] Inventor: Kenneth Jacobs, Bramley, England

[73] Assignee: The Stanley Works, New Britain, Conn.

[21] Appl. No.: 378,743

[22] Filed: Jan. 26, 1995

Related U.S. Application Data

[63] Continuation-in-part of PCT/US93/04975, May 26, 1993.

[51] Int. Cl.[6] ..... A47F 5/00

[52] U.S. Cl. ..... 211/90; 211/187; 211/153; 108/180

[58] Field of Search ..... 211/90, 187, 153, 211/186, 207; 108/109, 185, 152, 180

[56] References Cited

U.S. PATENT DOCUMENTS

| | | | |
|---|---|---|---|
| 2,527,253 | 10/1950 | Hedfield et al. | 248/239 |
| 2,915,196 | 12/1959 | Pira . | |
| 2,975,908 | 3/1961 | Huet | 108/185 |
| 3,081,718 | 3/1963 | Shoffner | 108/108 |
| 3,179,257 | 4/1965 | Tassell . | |
| 3,221,678 | 12/1965 | Doherty | 108/152 |
| 4,241,669 | 12/1980 | Giambalvo | 108/152 |
| 4,548,327 | 10/1985 | Kilkelly | 211/187 |
| 4,603,781 | 8/1986 | Ryan | 211/90 |
| 4,706,824 | 11/1987 | Mercer et al. | 211/188 |
| 5,472,103 | 12/1995 | Merl | 211/90 X |

FOREIGN PATENT DOCUMENTS

| | | |
|---|---|---|
| 274084 | 7/1988 | European Pat. Off. . |
| 331381 | 9/1989 | European Pat. Off. . |
| 2470562 | 6/1981 | France . |
| 2601353 | 7/1977 | Germany . |
| 1065304 | 4/1967 | United Kingdom . |
| 1425603 | 2/1976 | United Kingdom . |
| 2236243 | 4/1991 | United Kingdom . |

*Primary Examiner*—Robert W. Gibson, Jr.
*Attorney, Agent, or Firm*—Christie, Parker & Hale, LLP

[57] ABSTRACT

A modular shelving system has a vertical stanchion for supporting load-bearing blocks. One end of each block fits into a T-shaped channel of the stanchion. A self-tapping screw threaded into the block engages the back wall of the channel and forces the block against the shoulders at the mouth of the channel. A pointed tip on the screw pierces the back wall of the channel to keep the block from moving along the channel. Shelf brackets of generally U-shaped cross section may be attached to the blocks and a back wall and support either end of a shelf plank in the channel formed by the U-shape. A curved washer fits between the U-shaped shelf bracket and a stanchion or a closet wall for alignment. In another embodiment, a separate shelf plank has its ends concealed and supported by such U-shaped shelf brackets and a diagonal rod connected to the wall. An end cap conceals the front corner of the shelf. Since the ends of the shelf plank are concealed in the U-shaped brackets, unfinished ends and poorly aligned ends on the shelf plank are acceptable. Shelf planks may be formed from a plurality of interlocking metal shelf slats.

19 Claims, 10 Drawing Sheets

SHELVING SYSTEM

BACKGROUND OF THE INVENTION

This application is a continuation in part of International Application PCT/US93/04975, filed May 26, 1993.

A system of shelves and hanger bars installed within a closet or cupboard can provide economy of storage space for both closets under construction as well as existing closets. A modular system that is strong yet versatile is desirable so that it can be assembled to fit any size closet, and so that it can be customized by the homeowner to meet his or her particular needs. A system that is lightweight and compact before assembly is also desirable for ease of packaging and transportation prior to assembly. Finally, a system that is easily and quickly assembled with simply hand tools is desirable so that the system is capable of "do-it-yourself" assembly.

Some prior art systems provide shelving systems that are capable of infinite height adjustment by means of attaching friction-mounted shelf support blocks to vertical support members. However, when plastic shelf support blocks are used in such systems, they are generally incapable of carrying significant loads due to the block's tendency to slip.

Some other prior art systems provide a more sturdy shelf attachment by mounting shelf support blocks to pre-drilled holes in the vertical support members. However such systems generally have limited height adjustment as determined by the spacing of the pre-drilled holes.

Other prior art systems provide a sturdy, yet flexible installation by requiring the installer to drill holes to attach shelf supports to vertical support members. However, such systems can be difficult to install and typically require the use of power tools such as an electric drill. Furthermore, because of complicated assembly procedures, these systems are prone to mis-assembly by the inexperienced installer.

A system providing infinite shelf height adjustment with sturdy shelf supports capable of carrying significant loads and that is easily installed by an inexperienced installer using simple hand tools is desirable.

The shelves for prior art systems are often made of long pieces of wood, particle board or sheet metal. These shelves must either be used as provided or accurately trimmed to the desired dimensions. If a retailer were to stock the various sizes that a customer might desire, a huge inventory would be necessary. If the consumer were to personally trim the shelves, there is the risk that a minor flaw in the trimming could lead to a finished system that looks sloppy or is structurally weak. Even if the shelves were accurately and squarely trimmed, any flaws in the squareness of the closet walls to which the system is attached could once again lead to a sloppy or weak product.

A shelving system that offers a shelf support bracket that is capable of securely and neatly holding the shelf in place even if there are slight flaws in the trimming of the shelf or in the squareness of the walls to which the system is attached is desirable.

Prior art shelves are often heavy and difficult to package. A system of lightweight yet sturdy shelf planks that are easily trimmed to size and that can be combined to form a number of different shelf sizes that fit neatly into shelf brackets is desirable for quick and easy installation as well as lightweight and compact packaging of the system prior to assembly.

The present invention fulfills these needs by providing a lightweight, simple to install, easily packaged and versatile shelving system that is sturdy yet attractive when assembled.

SUMMARY OF THE INVENTION

One embodiment of this invention provides a modular shelf assembly for installation into a closet. The assembly comprises one or more vertical support members located near the front of the closet. Any number of blocks for supporting shelves or other accessories may be attached to each vertical support member. Each block snaps into a channel that runs the length of the support member. Each block is positioned to the desired height along the support member and a self-tapping screw is threaded into a guide hole in the block, first causing the sides of the block to spread and form a temporary grip to the support member. Then the screw is further driven into the block to engage and pierce the opposite wall of the support member, thereby effecting a rigid support.

Shelf brackets are attached to the blocks and/or to the side walls of the closet in the front and to the rear closet wall in back. Each shelf bracket has a generally U-shaped channel running most of its length. The channel is deep enough to support the shelf while hiding any imperfections in the squareness of the closet walls or minor flaws in the squareness of the trimmed shelves.

In one embodiment, shelves are assembled by trimming sheet metal shelf slats to the desired shelf width and then interlocking an appropriate number of slats together to achieve a shelf plank of desired depth. The ends of the shelf plank whether formed of slats or a particle board panel, for example, are slid into the channels of the shelf bracket. A shelf bracket end cap is placed over the exposed end of the channel to hold the shelf in place and further conceal any imperfections in the shelf ends.

Additional blocks may be attached to the stanchions and/or walls of the closet. These blocks can be used to attach additional shelves, drawers, shoe racks, hanger bars or other accessories until the desired customized closet system has been achieved. Blocks can also be used to attach horizontal support members between the stanchions and the side or rear walls of the closet to provide additional rigidity to the structure.

Another embodiment of shelving system comprises a single shelf supported from a wall by a shelf bracket and a diagonal rod between a front portion of the shelf and the wall. The ends of the shelf plank are encompassed in a generally U-shaped shelf bracket at each end. The back end of the shelf bracket is attached to the wall. A shelf bracket cap at the front end of the shelf bracket conceals a front corner of the plank. The diagonal rod has one end fastened by screws to the front portion of the shelf bracket and to the wall at a location above the shelf.

7 is a top view of a black assembly with parts exploded.

Figure 8:
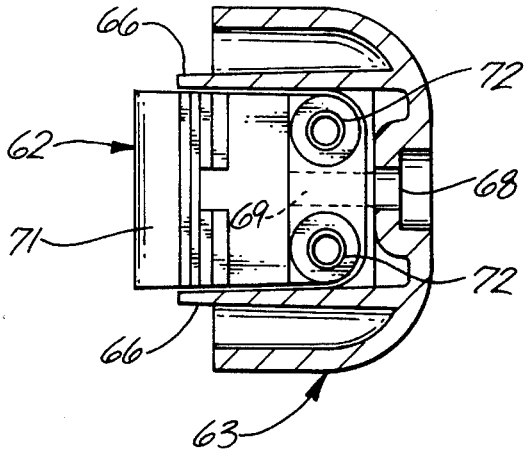

FIG. 8 is a side view of a block cover.

Figure 9:
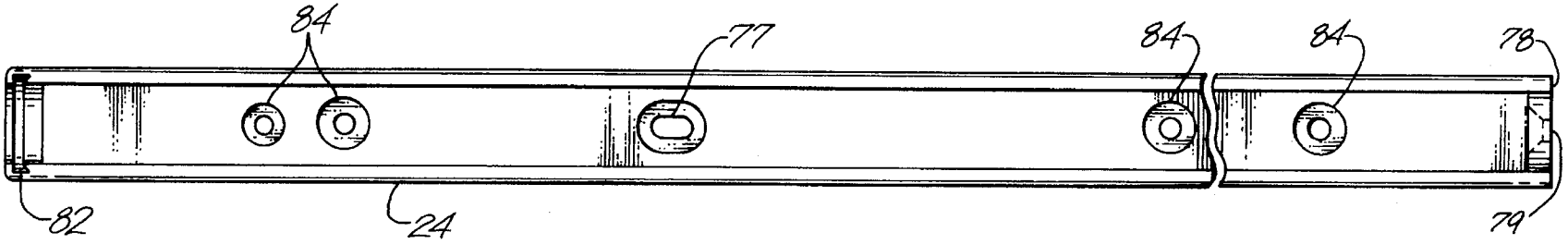

FIG. 9 is a side view of a shelf bracket facing the mouth of the channel.

Figure 10:
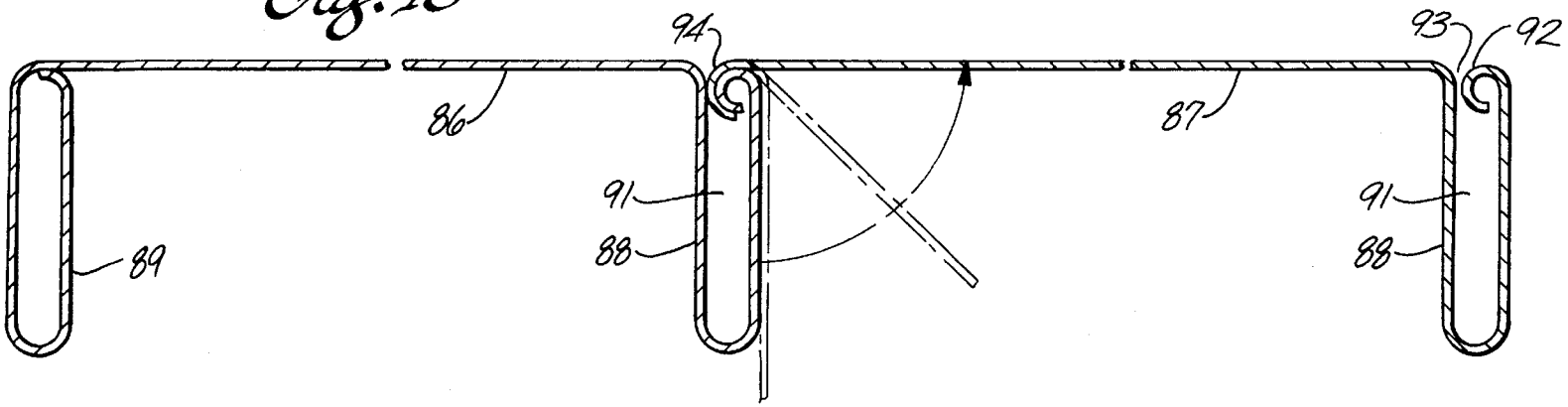

FIG. 10 is a transverse cross section of two shelf slats. The phantom lines show the slats during assembly.

Figure 11:
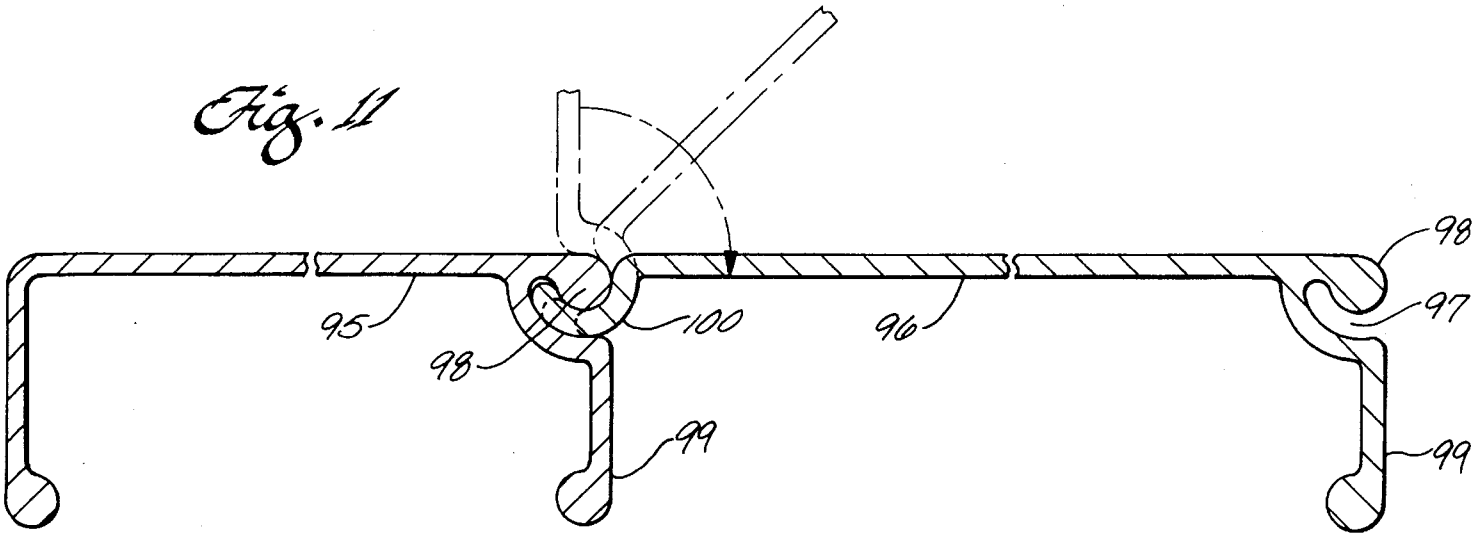

FIG. 11 is a transverse cross section of two shelf slats of an alternative design. The phantom lines show the slats during assembly.

Figure 12:
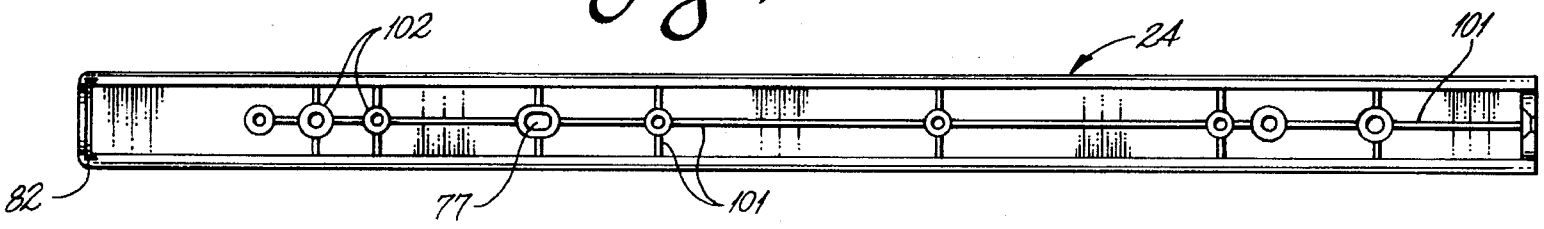

FIG. 12 is a side view of another embodiment of shelf bracket.

Figure 13:
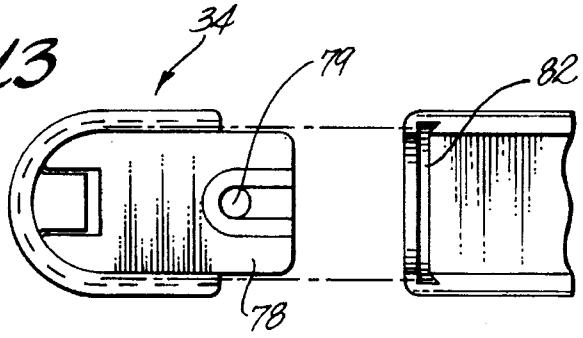

FIG. 13 is an end view of the shelf bracket illustrated in FIG. 12.

Figure 14:
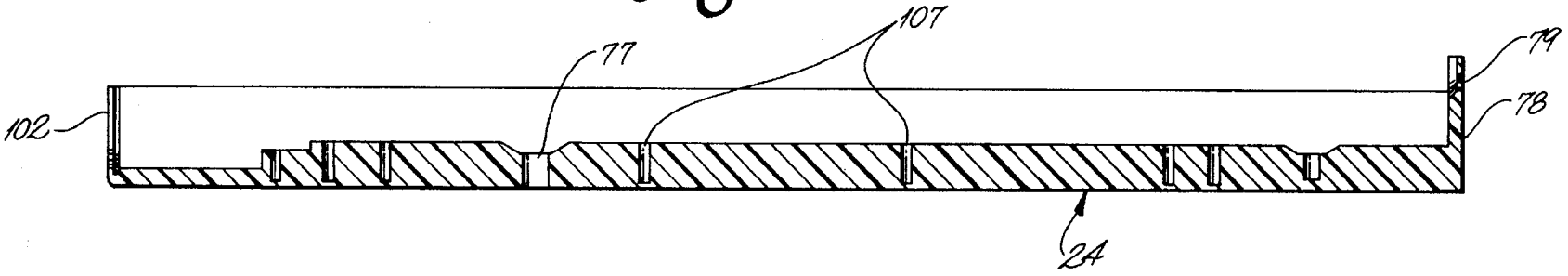

FIG. 14 is a longitudinal cross section of the shelf bracket illustrated in FIG. 12.

Figure 15:
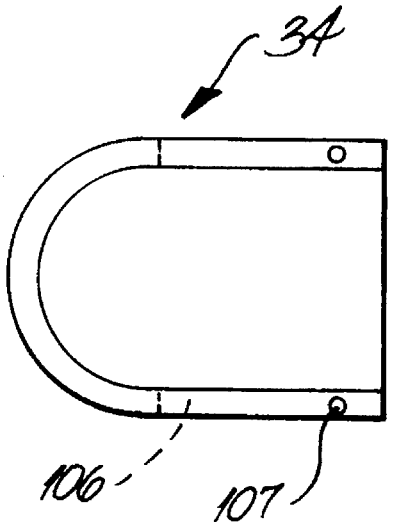

FIG. 15 is a side view of a shelf bracket cap.

Figure 16:
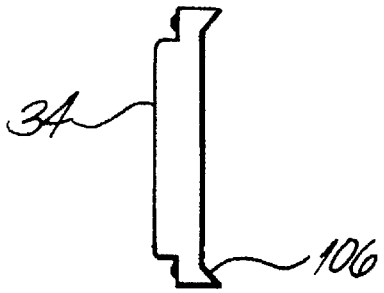

FIG. 16 is an end view of the shelf bracket cap.

Figure 17:
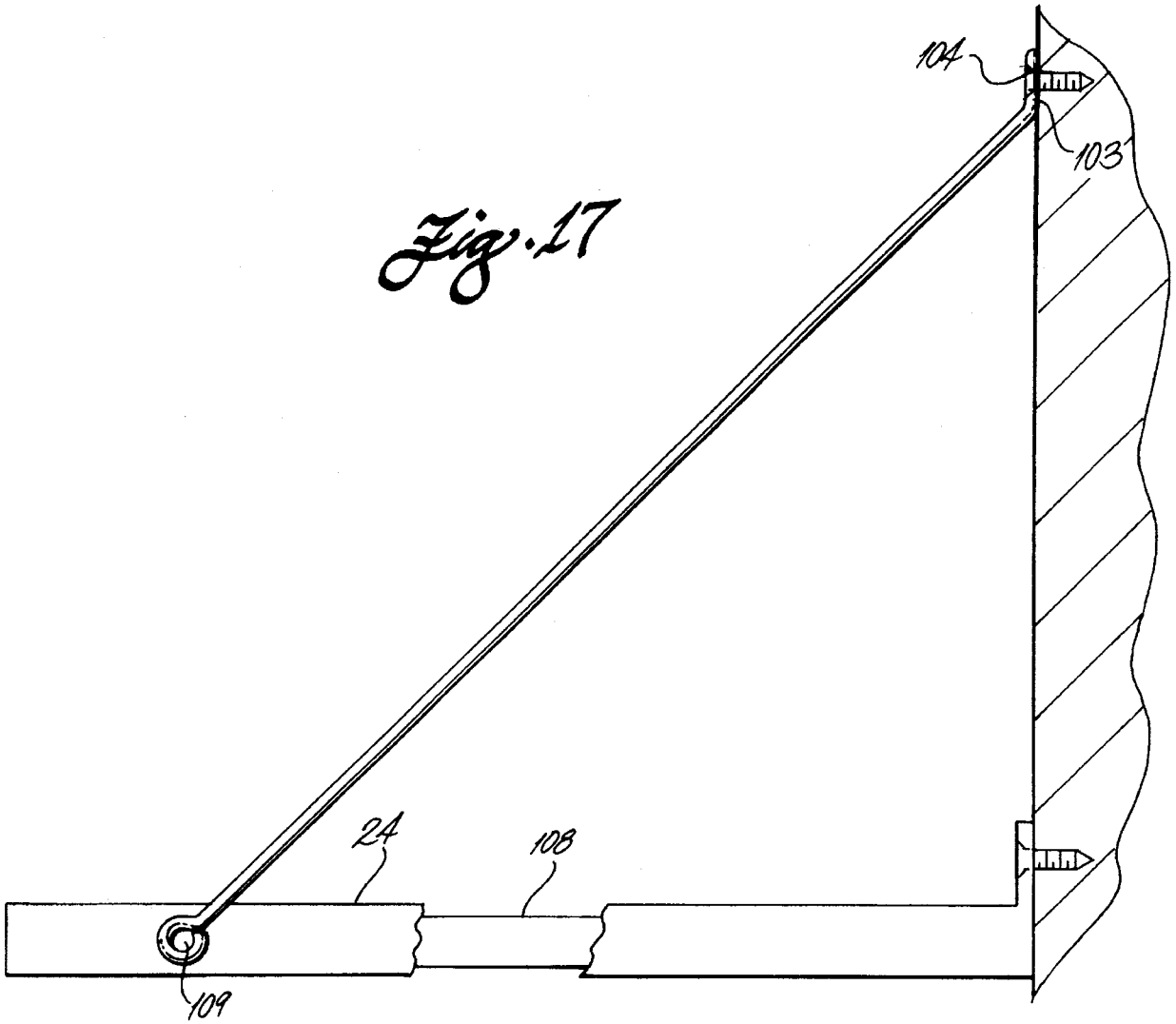

FIG. 17 is an end view of a shelf supported by a rod secured to a wall.

DETAILED DESCRIPTION

Figure 1:
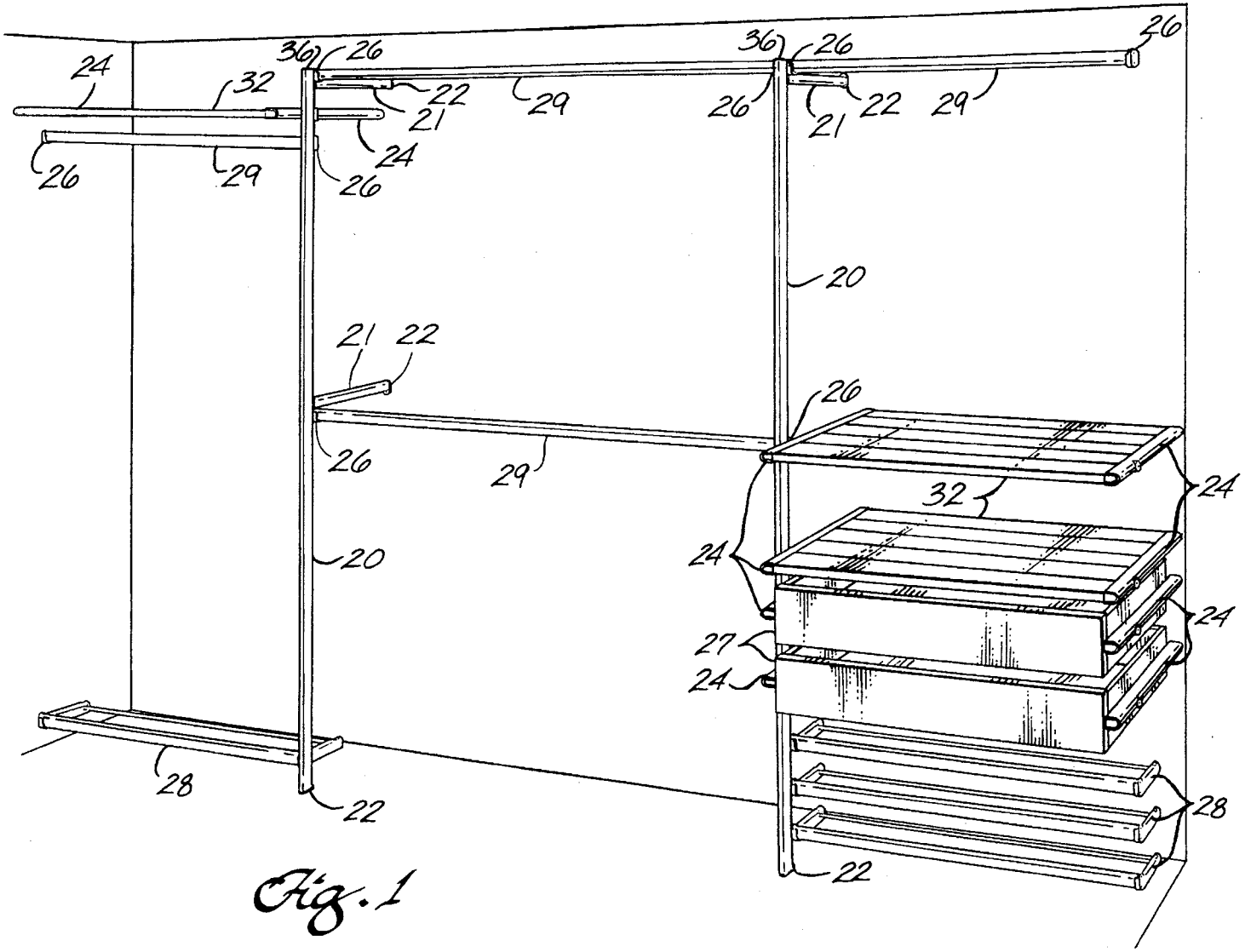
FIG. 1 is an isometric front view of one exemplary configuration of this type of shelving system.

A shelving system as provided in practice of this invention can be installed in spaces of varying depth, width and height into an unlimited number of various configurations. In this example, as is shown in FIG. 1, a pair of vertical support members or stanchions 20 placed towards the front of the closet are used along with the back and side walls of the closet to provide vertical support for the system. Horizontal support members 21 located at the top of each stanchion connect each stanchion to the rear wall of the closet for additional support. The support members are firmly attached to either the floor or the wall by flat brackets 22. A self-tapping screw (not shown in FIG. 1) attaches the support member to the flat bracket and a screw (not shown) attaches the flat bracket to the floor or wall of the closet. Horizontal and vertical support members are attached to each other through the use of L-brackets and self-tapping screws (not shown in FIG. 1). As is shown in FIG. 2, numerous block assemblies 23 are attached to the vertical support member with self-tapping screws (not shown in FIG. 2) and are used to support horizontal shelf brackets 24, hanger bar brackets 26, drawers 27, or shoe racks 28 as shown in FIGS. 1 and 2.

Figure 2:
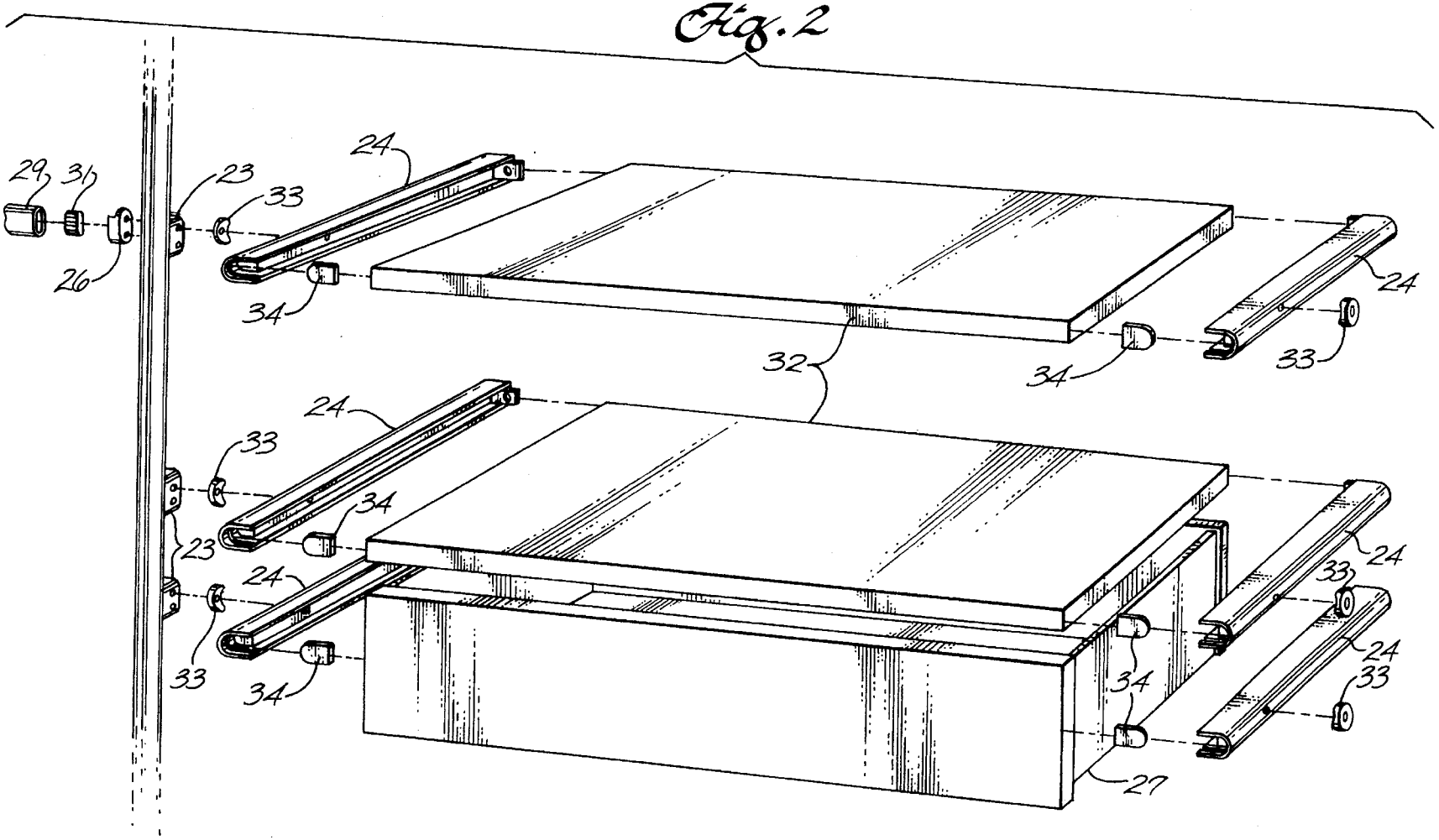
FIG. 2 is a fragment of the shelving system in FIG. 1 with parts exploded.

A hanger bar bracket is secured to a block assembly with a screw (not shown in FIGS. 1 and 2). A hanger bar 29 is preferably made from prepainted sheet metal that is roll formed to a generally oval cross section. A bung 31 that is preferably made of ABS or other plastic is placed in each end of a hanger bar. The notched surface of the bung is plastically deformed when the hanger bar is inserted into the hanger bar bracket. This causes the hanger bar to be firmly held in place.

The shelf brackets 24 have a U-shaped transverse cross section and are attached to the block assemblies or walls with screws (not shown in FIGS. 1 and 2) and used for receiving the end of a shelf plank 32 or a drawer assembly 27. The rear of each shelf bracket is additionally secured to the rear wall of the closet with a screw (not shown in FIGS. 1 and 2). Shelf brackets located on the sidle of the closet are attached directly to the side wall of the closet with screws (not shown in FIGS. 1 and 2). Curved washers 33 between the shelf bracket and either the wall or support block provide a neat and sturdy connection and accommodate walls which are not perpendicular to the length of the shelf. Each shelf plank is placed into a pair of shelf brackets at its opposite ends. Shelf bracket caps 34 are placed on the front of each shelf bracket for securing the shelf and providing a neat finished appearance. Finally, stanchion caps 36 are placed on the top of each vertical support member further contributing to a neat appearance.

If desired, a vertical partition may be placed in a closet to support the ends of the shelves instead of or in addition to a vertical stanchion. In such a shelving system the ends of the partition may be mounted in "shelf" brackets, i.e. U-shaped brackets which fit the ends of the partition. The lower bracket is secured to the floor by screws extending through curved washers of the same kind that fit between a shelf bracket and an adjacent wall. The top of the partition may also be mounted in a U-shaped bracket, the rear end of which is fastened to the back wall of the closet by a screw.

Figure 3:
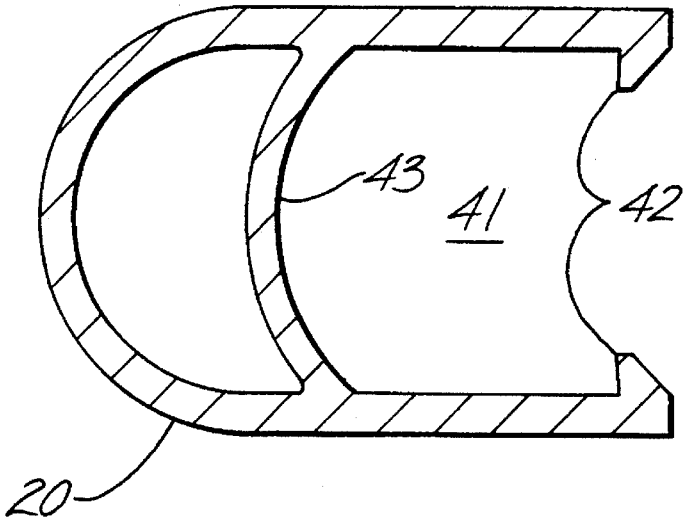
FIG. 3 is a transverse cross section of a vertical or horizontal support member.

The transverse cross section of a stanchion 20 is shown in FIG. 3. Note that a horizontal support member 21 has an identical cross section. Such support members are preferably made of extruded aluminum. Each support member has a channel 41 running its length which is used to hold the various brackets and blocks in place. The channel has a generally T-shaped cross section with shoulders 42 straddling the mouth of the channel and providing a means for gripping the bracket or block that is located within this channel. The inner wall or septum 43 of the support member provides a concealed surface to which the brackets and blocks can be firmly attached. By concealing this surface, the finished assembly has a neater overall appearance. The purpose of this inner wall will be more clearly understood when the mechanics of attaching support blocks and brackets to the support member are examined.

Figure 5:
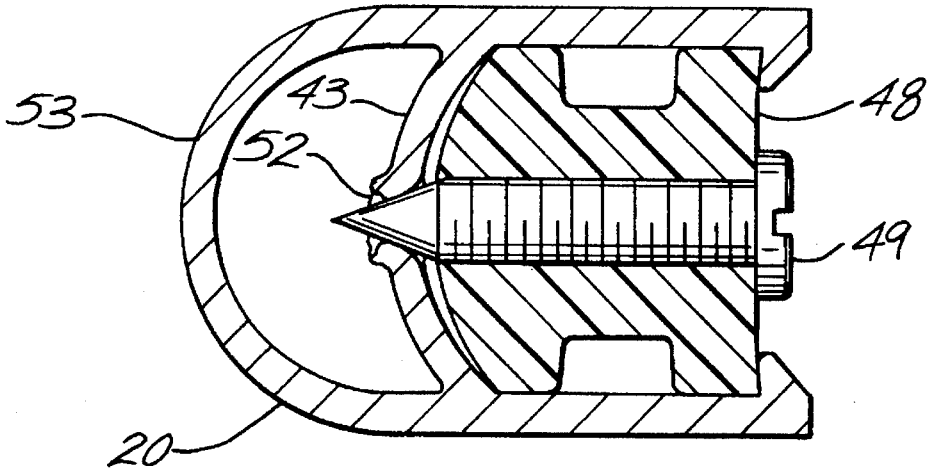
FIG. 5 is a transverse cross section of a support member with the flat bracket and self-tapping screw in place.
Figure 4:
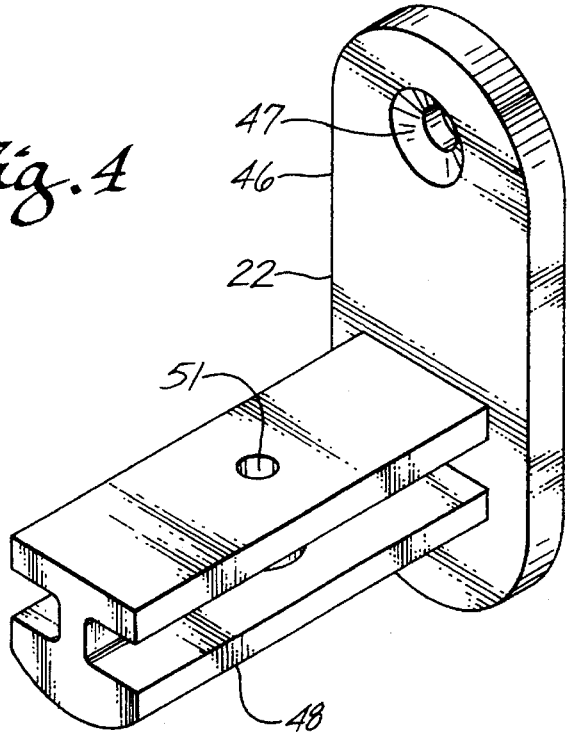
FIG. 4 is an isometric view of a flat bracket.

A flat bracket 22 is shown in isometric view in FIG. 4. A transverse cross section of a support member with the flat bracket and self-tapping screw is shown in FIG. 5. The flat bracket attaches either a horizontal or vertical support member to either the wall or floor of the closet. The flat bracket is preferably made from injection-molded plastic such as ABS. The base 46 of the flat bracket has a hole 47 which is used to secure the bracket to the wall or floor with a screw. The screw head is preferably countersunk for a neater appearance. A T-shaped plug 48 protruding from the base of the flat bracket is inserted into the channel of the support member. A self-tapping screw 49 is then driven into a pilot hole 51 in the plug. The screw threads firmly into the plug until its end engages the inner wall of the support member. By further driving the screw into the flat bracket, the bracket is pushed away from the inner wall of the support member and is tightly gripped to the shoulders of the channel. Driving the screw still further causes a sharp tip on the screw to pierce a hole 52 into the inner wall of the channel and create a very secure joint. The aluminum of the extruded support member plastically deforms to create the hole for the tip of the screw, obviating any need to pre-drill a hole to receive a screw. Since the inner wall 43 is pierced rather than the outer wall 53 of the support member, no sharp ends protrude from the support member. The result is a connection that is neat and safe and that has remarkable strength.

Figure 6:
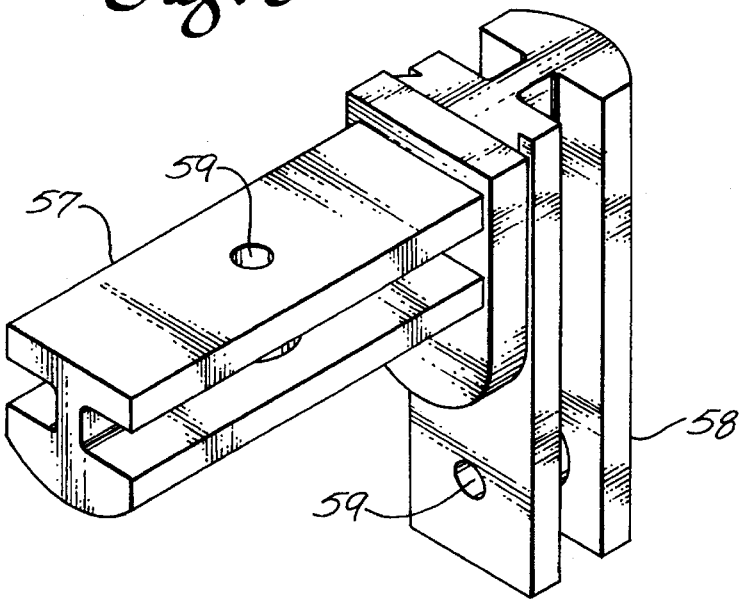
FIG. 6 is an isometric view of an L-bracket.

An L-bracket 56 as shown in FIG. 6 is used to join vertical and horizontal support members firmly together. L-brackets are preferably made of injection molded plastic such as ABS. The vertical extension 57 of the L-bracket is slipped into the T-shaped channel of a stanchion and the horizontal extension 58 of the L-bracket is slipped into the T-shaped channel of a horizontal support member. Self-tapping screws are driven through pilot holes 59 in the L-bracket to secure the assembly in the same way the flat bracket is attached to a support member as described above. The pointed tip of the screw piercing the inner wall of the support member forms a strong connection securing the support members together without pre-drilled holes.

Figure 7:
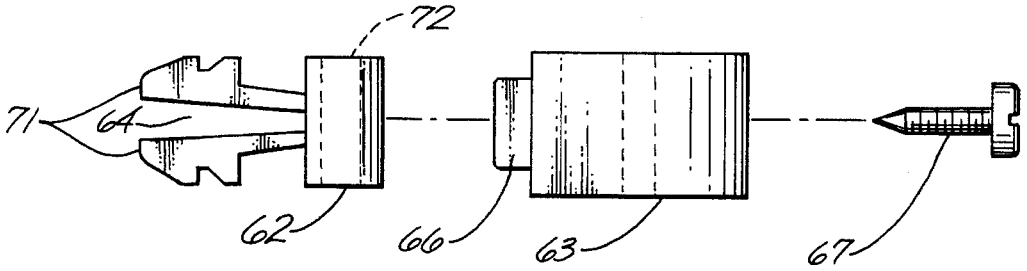

A block assembly is used to attach a shelf bracket to a stanchion as is shown in top view in FIG. 7 with parts exploded, and in cross section of the side view in FIG. 8 with parts exploded. Each block assembly is made up of an inner block 62, a portion of which fits into the channel of the stanchion, and a block cover 63 that fits over the inner block. Both the inner block and block cover are preferably made of injection molded plastic such as ABS. The inner block has a wedge shaped cutout or slot 64 on the end that is inserted into the channel of the stanchion. This slot allows the block to be elastically deformed so that its end can be snapped into the channel at any point along the channel. The end of the block is shaped somewhat like an arrowhead so that it can readily be pushed into the slot and has shoulders to that it does not come out of the T-shaped channel. After the block is snapped into the channel, a block cover is placed over the block. The block cover has tabs 66 which extend part way into the channel and help prevent the inner block and block cover from rotating.

A self-tapping screw 67 is inserted through a clearance hole 68 in the block cover and threaded through a pilot hole 69 of the inner block. As the self-tapping screw threads into the inner block it causes the legs 71 created by the wedge-shaped cutout to spread, making the inner block expand slightly. This expansion makes the inner block fit snugly in the channel, allowing it to be held firmly for temporary positioning along the channel. Once the desired position has been established the self-tapping screw is further driven into the inner block, first engaging the inner wall of the stanchion and pushing the inner block away from the back wall of the channel and firmly seating the block against the shoulders of the channel. Finally in the same fashion as was described for securing the flat bracket to a support member, the tip of the self-tapping screw is driven into the inner wall of the support member to create a very secure connection. The screw also draws the block cover against the inner block, gripping the shoulders at the mouth of the channel, along an appreciable length of the stanchion. By using this method to attach the block to the support member, shelves can be securely fastened at any point along the length of the support member without pre-drilled holes.

If desired a one piece support block may be used for connection to the stanchion. Such a one piece block is essentially the same as having the block cover and inner block permanently secured together. The two piece support block assembly is preferred so that the connection to the shoulders at the mouth of the channel can be made tightly without as much concern for manufacturing tolerances on both the extruded aluminum stanchion and injection molded plastic support block.

It may be noted that the connection between the support block, flat bracket or the like and the stanchion is a combination of effects. The screw forces the block against the shoulders at the mouth of the channel. It is these shoulders which prevent the block from moving out of the channel. The thread on the screw does not necessarily engage the back wall of the channel, so the screw is not relied on for any tension load-carrying capacity. The block is prevented from moving along the length of the channel by friction between the block and shoulders, and more significantly, by the engagement of the tip of the screw with the back wall of the channel. The tip of the screw has a shear load preventing motion along the length of the channel. A connection of this sort has been shown capable of supporting more than a 100 kg. load along the length of the channel.

Once assembled, transverse holes 72 in both the inner block and block cover coincide to provide a means for anchoring a shelf bracket or other hardware to the vertical support member.

U-shaped shelf brackets are used to hold shelf planks in place. FIG. 9 is a side view of a shelf bracket 24 looking into the mouth of the channel. The shelf bracket is preferably made from injection molded plastic such as ABS or nylon. The shelf bracket has a U-shaped transverse cross section with a U-shaped channel running most of its length which is used to support the shelf plank. An elongated hole 77 through the side of the shelf bracket is used for a screw to fasten a shelf bracket to a support block located on a stanchion or to a side wall of the closet. A curved washer having one face shaped to fit the curve of the outside of the shelf bracket is inserted between the bracket and block or bracket and wall to provide a firm and neat attachment. The elongated hole through the side of the shelf bracket has a recess that allows the screw to be countersunk. The hole is elongated to allow more flexibility in assembly by allowing adjustment to account for any differences in the distance between the vertical support member and the rear wall of the closet due to slight imperfections in the squareness of the wall.

Instead of the channel running the entire length of the shelf bracket, a small tab 78 is left at the rear of the bracket and is used to attach the shelf bracket to the rear wall of the closet. A hole 79 is located in this tab and is recessed to allow a screw to be countersunk through the hole, anchoring the shelf bracket to the rear wall of the closet.

Another screw is inserted through the elongated hole of the shelf bracket, through a curved washer and is driven into either a block assembly 23, or the side wall of the closet.

Once a pair of shelf brackets has been firmly attached to the vertical support member and a closet wall, for example, a shelf plank can be slipped into the channels of the two support brackets. By using this channeled shelf bracket, any slight imperfections in the end of the shelf are concealed. Furthermore, such an assembly will also hide any slight imperfections in the squareness of the walls to which the entire assembly is attached. Finally, a shelf bracket cap 34 is locked into the exposed end of the shelf bracket channel. A dove-tailed slot 82 in the end of the shelf bracket channel and a corresponding dove-tailed lip on the shelf bracket cap lock the two pieces together. This shelf bracket cap holds the shelf assembly firmly in place and further conceals any imperfections in the shelf assembly. Shelf bracket caps are preferably made of injection molded plastic such as ABS or nylon.

It may be noted that with this type of shelf assembly, the shelf brackets may not be parallel with each other and the ends of the shelf plank may be unfinished and crooked without detriment. The shelf bracket adjacent the wall, for example, is parallel to the wall and spaced from it by the curved washers. The end of the shelf plank is simply slipped into the bracket. The U-shaped channel which receives the end of the plank is deep enough that an appreciable discrepancy in plank length is hidden by the bracket and imperfect ends are thereby concealed. Interestingly, there is nothing secured to the shelf: its ends are simply trapped inside the shelf end brackets. This permits use of economical shelving materials without finishing the ends with great care or precision.

It will also be noticed because of the washers between the shelf bracket and an adjacent wall and because of the tab at the end of the shelf brackets where the bracket is connected to the wall, the edges of the shelves are spaced a short distance from the adjacent walls. This is beneficial for accommodating non-flat or non-perpendicular walls.

The shelf bracket is also designed to accommodate drawer runners through the use of blind holes 84 in the shelf bracket as shown in FIG. 9. This hole only extends part way through the shelf bracket. Self-tapping screws are driven into these holes piercing through the wall of the channel in the shelf bracket and attaching the drawer runners. If the shelf bracket is located against the side wall of the closet, the shelf bracket can be further secured to the wall by screws through these blind holes.

Although wood or particle board shelf planks are suitable, if desired, the shelf plank for the system can be assembled from a number of interlocking shelf slats. FIG. 10 is a cross section of one exemplary embodiment for two shelf slats 86 and 87. The shelf slats are preferably made from sheet metal which has been pre-painted and roll formed to shape. The shape of the shelf slats is designed to allow them to interlock. A vertical flange 88 extends downwardly from one edge of each slat to make the assembled shelf plank rigid. The front slat 86 has an additional vertical extension 89 in front to provide additional support for the front of the assembled shelf plank, and a flat or decorative front for the plank. The rear edge of each shelf slat has a downwardly extending flange made by forming a deep U-shaped channel 91. At the top of the channel there is cylindrical bead 92 formed by rolling the edge of the sheet almost 360° over the top of the channel. This leaves a narrow slot 93 with an upwardly facing mouth between the bead and the horizontal top of the slat. The front edge of each slat (except the front slat which has a flange at the front) has a J-shaped lip 94 extending tangent to the horizontal top of the slat and curving downwardly approximately 180° beneath the top of the slat. The J-shaped lip has an inner face complementary to the cylindrical bead. The engagement of the lip and bead prevents translation of the lip relative to the bead in any direction. It is significant that the lip extends more than 90° around the bead to prevent a rearward slat from lifting off of the forward slat.

To assemble the adjacent slats, the rearward one is positioned with its horizontal top face extending downwardly and the J-shaped lip over the bead with its, edge at the mouth of the slot adjacent the bead as illustrated by the phantom lines of FIG. 10 showing one of the adjacent shelf slats during assembly. The rearward slat 87 is attached to the forward slat 86 by rotating the rearward slat into the horizontal position, as seen in the solid lines in FIG. 10. Any number of slats identical to the rearward slat 87 can be joined until the desired shelf width is achieved.

A cross section of an alternative slat design is shown in FIG. 11. This design is preferably made from extruded aluminum. These slats 95 and 96 are joined in a fashion similar to that described above. In this embodiment, the forward slat has a generally U-shaped channel 97 between a cylindrical bead 98 and a downwardly extending flange 99 at the rear of the slat. The channel has a horizontally opening mouth for receiving a J-shaped lip 100 on the forward edge of the rearward slat. The J-shaped lip is upwardly concave and extends in a generally horizontal direction from the edge of the slat. The slats are assembled by tilting the rearward slat upwardly as shown by the phantom lines in FIG. 11, with the inside of the J-shaped lip against the bead and the edge of the lip at the mouth of the channel. When the tilted slat is rotated back into position, as illustrated in solid in FIG. 11, the two slats are locked in place. The fit of the lip into the channel prevents translation of the rearward slot in any direction relative to the forward slat. In both embodiments, the slats may be disengaged by rotation.

Note that the system that has been described above is but one configuration of this general shelving system. More or fewer vertical support members can be used and additional shelves can be added or replaced with hanger bar brackets and hanger bars or shoe racks, drawers, tie racks or various other accessories. Horizontal support members connecting the stanchions to a wall may be eliminated if shelves are located to provide sufficient support for the system. Wooden shelves or veneer covered particle board shelves or other types of shelf plank may be used in place of the multiple slat shelves described above. Shelf brackets may incorporate designs other than the general U-shaped set forth in this example.

Various other designs are also possible for the support members. In this embodiment each stanchion has an inner wall that is desireable in that it prevents the sharp screw ends from protruding out from the vertical support member. However, the inner wall is not a necessary component of the system.

The general method of assembly in the shelving system that is disclosed by this specification is very versatile and capable of numerous variations. The basic components of this system are not just limited to closet shelf design but may be incorporated into other applications such as for furniture assembly or other systems where a load bearing block is to be securely attached to a support member.

FIGS. 12 to 17 illustrate another embodiment of shelf constructed according to principles of this invention and the parts used for assembling such a shelf. FIG. 17 is an end view of the shelf with a portion of an end shelf bracket 24 cut away to show a shelf plank 108.

FIGS. 12 to 14 illustrate a slightly different embodiment of shelf bracket 24, as hereinabove described and illustrated in FIG. 9. A principal difference in this embodiment of shelf end bracket is a reduced wall thickness at the root of the U-shaped transverse cross section of the bracket and addition of slender reinforcing webs 101. This reduces the quantity of material used without changing the functioning of the bracket. Various blind and through holes in the U-shaped channel forming the shelf bracket are in raised bosses 102.

FIGS. 15 and 16 illustrate a shelf bracket end cap which fits into the shelf bracket.

FIG. 17 illustrates a shelf support rod 105 used for supporting the shelf against a wall. Such a shelf preferably comprises a plastic laminate chip board plank 108, or may be formed from roll formed metal planks, as hereinabove described. An end bracket 24 is bolted to a wall by a screw extending through a hole 79 in a tab 78 at the back end of the shelf bracket. Such a shelf bracket is employed at each end of the shelf. A shelf end bracket for such an individual shelf may be readily injection molded with high strength nylon reinforced with about 15% glass beads and 15% glass fibers.

A plank is inserted into the open front end 102 of the two brackets at the ends of the shelf. Meanwhile, an upper end 103 of the support rod is secured to the wall above the shelf by way of a screw through an eye 104 in the upper end of the rod. Another screw passes through an eye 106 through the lower end of the rod and through a mounting hole 77 in the shelf bracket into the shelf plank. Thus, the diagonally extending rod supports the shelf nearer its front edge.

The appearance of the shelf is finished by inserting a shelf bracket cap 34 into a peripheral slot 82 inside the front end of the U-shaped shelf bracket. The cap conceals the front corner of the shelf plank. The slot in the shelf bracket has a dovetail portion which is engaged by a dovetail lip 106 along each edge of the cap, which is complementary to the dovetail in the peripheral slot. The dovetail lip 106 extends only along the straight portion of the cap, since the dovetail groove in the slot extends only that far for ease of injection molding the shelf bracket. A pair of slightly raised bumps 107 on the opposite face of the end cap assures a tight friction fit in the groove in the shelf bracket. The dovetails provide strength at the front end of the shelf bracket to minimize shelf sagging.

Blind holes 107 in the shelf bracket are not used in an embodiment where an individual shelf is mounted on a wall and supported by a support rod at each end. The blind holes are available for other uses of the shelf bracket.

What is claimed is:

1. A shelving system comprising:

a generally horizontal shelf having a back edge adjacent a wall and end edges at each end of the shelf;

an shelf bracket at each end of the shelf, each such shelf bracket comprising:

a U-shaped channel encompassing the end edge of the shelf, a front hole through the root of the U-shaped channel for receiving a mounting screw, a tab closing a back end of the U-shaped channel and including a back hole for receiving a mounting screw secured to a wall, and a peripheral slot inside a front end of the U-shaped channel; and a shelf bracket cap complementary to the slot in the shelf bracket for concealing a front corner of the shelf.

2. A shelving system as recited in claim 1 wherein the peripheral slot comprises a dovetail groove and the shelf bracket cap comprises a dovetail lip complementary to the dovetail groove in the shelf bracket.

3. A shelving system as recited in claim 2 further comprising a diagonally extending rod at an end of the shelf having one end of the rod connected to a wall above the back of the shelf and another end of the rod connected to a mounting screw extending through the front hole in the U-shaped channel.

4. A shelving system as recited in claim 1 further comprising a diagonally extending rod at an end of the shelf having one end of the rod connected to a wall above the back of the shelf and another end of the rod connected to a mounting screw extending through the front hole in the U-shaped channel.

5. A shelving system comprising:

a shelf plank;

a generally U-shaped shelf bracket at each end of the shelf plank, a back end of the shelf bracket being attached to an adjacent wall, each end of a plank fitting into one of said shelf brackets so that the ends of the shelf plank are concealed by the shelf bracket;

a shelf bracket cap at a front end of the shelf bracket for concealing a front corner of the plank; and means for connecting a front portion of the shelf bracket to the adjacent wall at a location above the shelf.

6. A shelving system as recited in claim 5 wherein the means for connecting the front portion of the shelf bracket to the wall comprises a diagonal rod between a front portion of the shelf bracket and the wall.

7. A shelving system comprising:

a vertical stanchion;

a shelf or shelves attached to the stanchion and to an adjacent wall;

a generally U-shaped shelf bracket at each end of a shelf plank forming such a shelf, each end of the shelf plank fitting into a shelf bracket so that the ends of the shelf plank are concealed by the shelf bracket; and means for connecting the shelf brackets to the stanchion and an adjacent wall.

8. A shelving system as recited in claim 7 wherein the means for connecting such a shelf bracket comprises a washer having one curved face for fitting the outside of the shelf bracket and a flat face for fitting a wall.

9. A shelving system as recited in claim 8 wherein the means for connecting such a shelf bracket to a stanchion comprises a T-shaped channel in the stanchion having shoulders on each side of the mouth of the channel, a support block having a T-shaped portion fitted into the channel, a screw threaded through the support block and having a tip engaging the back wall of the channel opposite the mouth for biasing the support block toward the shoulders, and means for connecting the shelf bracket to the support block.

10. A shelving system as recited in claim 7 wherein the means for connecting such a shelf bracket to a stanchion comprises a T-shaped channel in the stanchion having shoulders on each side of the mouth of the channel, a support block having a T-shaped portion fitted into the channel, a screw threaded through the support block and having a tip engaging the back wall of the channel opposite the mouth for biasing the support block toward the shoulders, and means for connecting the shelf bracket to the support block.

11. A shelving system as recited in claim 10 wherein the screw has a pointed tip which pierces the back wall of the channel opposite the mouth for preventing movement of the support block along the channel.

12. A shelving system comprising:

a vertical stanchion;

a shelf or :shelves attached to the stanchion and to an adjacent wall;

means for connecting such a shelf to a stanchion comprising:

a T-shaped channel in the stanchion having shoulders on each side of the mouth of the channel, a support block having a T-shaped portion fitted into the channel, and a screw threaded through the block and having a tip engaging the back wall of the channel opposite the mouth, and means for connecting a shelf to the support block.

13. A shelving system as recited in claim 12 wherein the screw has a pointed tip which pierces the back wall of the channel opposite the mouth for preventing movement of the support block along the channel.

14. A shelving system as recited in claim 13 wherein the stanchion has a second wall spaced from the back wall opposite the mouth so that the tip of the screw piercing the back wall is hidden between the walls.

15. A shelving system as recited in claim 14 wherein the support block comprises an arrowhead shaped portion fitted into the channel and having shoulders for engaging the shoulders on each edge of the mouth of the channel and a slot in the arrowhead shaped portion fitted into the channel for allowing elastic deformation of the arrowhead shaped portion so that the block may be snapped into the channel at any point along the length of the channel.

16. A shelving system as recited in claim 12 wherein the support block comprises an arrowhead shaped portion fitted into the channel and having shoulders for engaging the shoulders on each edge of the mouth of the channel and a slot in the arrowhead shaped portion fitted into the channel for allowing elastic deformation of the arrowhead shaped portion so that the block may be snapped into the channel at any point along the length of the channel.

17. A shelving system comprising a shelf formed of a plurality of adjacent horizontal shelf slats interlocking with each other to form a shelf plank, and characterized by:

a first shelf slat having along its edge a downwardly extending flange forming a U-shaped channel and a cylindrical bead coupled to the flange adjacent a top portion of the U-shaped channel; and an adjacent second shelf slat having along its edge adjacent the first shelf slat a J-shaped lip having an inner face complementary to the cylindrical bead and extending more than 90° around the bead, for encountering the bead with the slats non-parallel and rotatable to a position with the slats parallel wherein the lip engages the bead and prevents translation of the second slat relative to the first slat.

18. A shelving system as recited in claim 17 wherein the U-shaped channel includes a horizontally opening mouth for receiving the J-shaped lip, the J-shaped lip being upwardly concave and extending in a generally horizontal direction from the edge of the slat.

19. A shelving system as recited in claim 17 wherein the first slat has a slot adjacent the bead with an upwardly facing mouth for receiving the edge of the J-shaped lip, and the second slat has a J-shaped lip extending tangent to the top of the slat and curving approximately 180° beneath the top of the slat.

* * * * *